US006708671B1

(12) United States Patent
Joos et al.

(10) Patent No.: US 6,708,671 B1
(45) Date of Patent: Mar. 23, 2004

(54) METHOD AND DEVICE FOR VARYING THE SUPPLY PRESSURE APPLIED TO A HIGH PRESSURE PUMP AND GENERATED BY A LOW PRESSURE PUMP

(75) Inventors: Klaus Joos, Walheim (DE); Jens Wolber, Gerlingen (DE); Thomas Frenz, Noerdlingen (DE); Hansjoerg Bochum, Novi, MI (US); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/111,612

(22) PCT Filed: Oct. 11, 2000

(86) PCT No.: PCT/DE00/03563

§ 371 (c)(1),
(2), (4) Date: May 28, 2002

(87) PCT Pub. No.: WO01/31184

PCT Pub. Date: May 3, 2001

(30) Foreign Application Priority Data

Oct. 26, 1999 (DE) ..... 199 51 410

(51) Int. Cl.[7] ..... F02M 41/00
(52) U.S. Cl. ..... 123/464; 123/497
(58) Field of Search ..... 123/464, 497, 123/512, 513, 457, 495

(56) References Cited

U.S. PATENT DOCUMENTS 4,404,944 A * 9/1983 Yamazaki et al. ..... 123/458
5,542,395 A 8/1996 Tuckey et al.
6,450,148 B2 * 9/2002 Nakamura et al. ..... 123/464
6,457,460 B1 * 10/2002 Doane et al. ..... 123/541

FOREIGN PATENT DOCUMENTS

| | | |
|---|---|---|
| DE | 195 39 885 | 11/1996 |
| DE | 198 18 421 | 10/1999 |
| EP | 0 336 060 | 10/1989 |

* cited by examiner

*Primary Examiner*—Mahmoud Gimie
(74) *Attorney, Agent, or Firm*—Walter Ottesen

(57) ABSTRACT

Method for varying a prepressure (p_des) generated by a low-pressure pump and applied to a high-pressure pump with the low-pressure pump (2) and the high-pressure pump (3) pumping fuel for the internal combustion engine (1). In order to keep the prepressure (p_des), on the one hand, as low as possible to take load off the low-pressure pump (2) and to, on the other hand, adjust the prepressure (p_des) so high that a vaporization of the fuel is reliably avoided, the invention suggests that: the actual temperature (T_Krst) of the fuel in the high-pressure pump (3) is determined; a prepressure (p_des) as low as possible is determined in dependence upon the fuel temperature (T_Krst) for which a vaporization of the fuel in the high-pressure pump (3) is reliably avoided; and, the low-pressure pump (2) is so driven or controlled that it generates the determined prepressure (p_des). The method is preferably carried out on the basis of physical models of the high-pressure pump (3).

10 Claims, 2 Drawing Sheets

METHOD AND DEVICE FOR VARYING THE SUPPLY PRESSURE APPLIED TO A HIGH PRESSURE PUMP AND GENERATED BY A LOW PRESSURE PUMP

FIELD OF THE INVENTION

The present invention relates to a method and an arrangement for varying a pressure generated by a low-pressure pump and applied to a high-pressure pump. The low-pressure pump and the high-pressure pump pump fuel for an internal combustion engine.

BACKGROUND OF THE INVENTION

Especially in modern direct-injecting internal combustion engines, pump arrangements are utilized to supply the engines with fuel and these pump arrangements include a low-pressure pump, the so-called presupply pump, and a high-pressure pump, the so-called primary supply pump. The low-pressure pump can be configured to be controlled as to requirements and then always pumps as much fuel as just needed by the high-pressure pump.

At specific operating points of the engine, a vaporization of fuel can occur in the high-pressure pump. The vapor formation in the high-pressure pump is facilitated by high temperatures in the high-pressure pump and by a low prepressure at which the fuel is applied to the high-pressure pump. When vapor is formed in the high-pressure pump, high pressure cannot be generated therein and the engine is only supplied inadequately with fuel which has negative effects on the operability of the engine.

From the state of the art, it is known to increase the prepressure with which the fuel is applied to the high-pressure pump in order to avoid the formation of vapor in the high-pressure pump. When utilizing a requirement-controlled low-pressure pump, the desired value of the fuel prepressure is variable and can be selected so high that under no circumstances a vapor formation occurs in the high-pressure pump. With increasing prepressure, the pumping capacity of the low-pressure pump, however, drops by approximately 20 liters per hour per 1 bar of pressure increase. At specific operating points of the engine, for example, at full-load operation, when the engine has a high requirement for fuel and simultaneously the fuel is applied with a high prepressure to the high-pressure pump, the low-pressure pump is greatly loaded and can, under circumstances, be pushed to its pumping limit which, in turn, has negative effects on the operability of the engine.

SUMMARY OF THE INVENTION

In an internal combustion engine, which is supplied with fuel by a low-pressure pump and a high-pressure pump, it is the task of the present invention, on the one hand, to reliably prevent a formation of vapor in the high-pressure pump and, on the other hand, to ensure the operability of the engine especially its supply of fuel at all operating points.

To solve this task, the invention proceeds from the method of the kind mentioned initially herein and suggests that:

- the actual temperature of the fuel in the high-pressure pump is determined;
- in dependence upon the fuel temperature, a prepressure as low as possible is determined at which a vaporization of the fuel in the high-pressure pump is reliably avoided; and,
- the low-pressure pump is so controlled (open loop and/or closed loop) that it generates the determined prepressure.

According to the present invention, the prepressure is therefore controlled (open loop and/or closed loop) in dependence upon the actual temperature of the fuel in the high-pressure pump. This affords the advantage that a vapor formation in the high-pressure pump is in each case reliably avoided. The prepressure is in each case only selected so high in dependence upon the determined fuel temperature that a vaporization of the fuel in the high-pressure pump is reliably avoided. This affords the advantage that the prepressure in no operating point of the engine (for example, for reasons of safety or other reasons) has too high a value and the low-pressure pump is thereby unnecessarily loaded. This leads to a longer service life of the low-pressure pump. Furthermore, a low-pressure pump requires less energy for a reduced prepressure. A low-pressure pump, which is configured as an electrical fuel pump has a lower power consumption. Finally, a reduced tank heating and lower permeation losses result because of the reduced prepressure.

According to a preferred embodiment of the present invention, it is suggested that the fuel temperature be estimated based on a physical model of the high-pressure pump in dependence upon the temperature of the high-pressure pump and specific condition variables of the engine.

According to an advantageous embodiment of the present invention, it is suggested that the actual throughput of fuel in the engine is determined and the fuel temperature in the high-pressure pump is determined while considering the fuel throughput. The more fuel the engine takes up from the high-pressure loop, the more cool fuel from the tank can be supplied to the high-pressure loop via the low-pressure pump. The supplied cool fuel effects a lowering of the fuel temperature in the high-pressure pump and thereby counters a formation of vapor in the high-pressure pump. Accordingly, with a high throughput of fuel into the engine, the prepressure, at which the fuel is applied to the high-pressure pump, can be correspondingly lowered.

According to an advantageous embodiment of the present invention, it is suggested that the temperature of the high-pressure pump be estimated based on a physical model of the high-pressure pump in dependence upon specific condition variables of the engine.

According to a preferred embodiment of the present invention, it is suggested that the prepressure be determined based on a fuel vapor pressure characteristic line from which a value of the prepressure is taken to which a safety-reserve pressure is added. This value of the prepressure corresponds to the fuel temperature. The fuel vapor pressure characteristic line is a function of the prepressure in dependence upon the fuel temperature in the high-pressure pump. From the high-pressure vapor pressure characteristic line, the corresponding value of the prepressure can be taken for a specific fuel temperature. This prepressure must be such that the fuel just does not vaporize. The fuel vapor pressure characteristic line is dependent upon the type of fuel. Accordingly, for example, freshly tanked winter fuel already vaporizes at lower temperatures than corresponding summer fuel. In this way, a proper combustion of the fuel even under extreme cold winter weather is to be ensured. Correspondingly, the fuel vapor pressure characteristic line of winter fuel runs above the corresponding characteristic line of summer fuel. A safety reserve pressure is added to the value of the prepressure taken from the fuel vapor pressure characteristic line which safety reserve pressure is so selected that a vaporization of the fuel in the high-pressure pump is reliably avoided.

Alternatively, and in accordance with a further embodiment of the present invention, it is suggested that the prepressure be estimated based on a physical model of the high-pressure pump in dependence upon specific condition variables of the engine. As condition variables, the same condition variables are advantageously applied as for the model-based estimate of the fuel temperature.

As condition variables, especially the following are advantageously applied: the temperature of the engine, of the intake air and/or of the ambient temperature, the integral of the fuel throughput and/or of the air throughput, the pump capacity, the lost power and/or the efficiency of the high-pressure pump, the rpm of the high-pressure pump and/or of the engine, the fuel/air ratio lambda and/or the drive of the quantity or pressure control valve. The fuel temperature therefore does not have to be measured separately, but can be estimated based on specific condition variables of the engine which, as a rule, are anyway detected and are available.

Advantageously, the condition variables of the engine are weighted in dependence upon the kind of engine and on the operating point. According, for example, directly after the start of the engine, it can be necessary to weight the condition variables in such a manner that, for the modeled fuel temperature, the fact is accounted for that the fuel in the high-pressure pump directly after the start of the engine has a relatively low temperature independently of the condition variables of the engine and that this temperature slowly increases within increasing duration of operation of the engine.

According to a preferred embodiment of the present invention, it is suggested that the fuel vapor pressure characteristic line is determined for a worst-case scenario and is stored. A worst-case scenario is present, for example, for freshly tanked winter fuel. The vapor pressure curve of winter fuel requires relatively high prepressures. To this, a safety reserve is provided so that also in the worst-case scenario, a vaporization of fuel in the high-pressure pump is reliably avoided. If a fuel is present at low volatility (for example, summer fuel or old fuel), lower prepressures would be possible at the same temperatures than in the worst-case scenario. The spacing of the worst-case characteristic line plus safety reserve from the actual vapor pressure curve of the fuel present is unnecessarily great in this case.

According to another advantageous embodiment of the present invention, it is therefore suggested that the nature of the tanked fuel be detected and the stored fuel vapor pressure characteristic line be adapted to the type of tanked fuel. For detecting the type of tanked fuel, a tanking detection is utilized, which, for example, can distinguish summer fuel from winter fuel or fresh fuel from old fuel. Via the adaptation, the stored fuel vapor pressure characteristic line can be adapted to the actual fuel pressure vapor characteristic line and the safety reserve pressure can be reduced.

As a further solution of the present task, the invention suggests furthermore an arrangement of the type mentioned initially herein which has means for carrying out the method of one of the claims 1 to 10. The arrangement according to the invention can be configured as an independent control unit or can be integrated into a higher order control apparatus of the engine.

According to an advantageous further embodiment of the present invention, the high-pressure pump pumps fuel for a direct-injecting internal combustion engine. Especially for engines of this type, a formation of vapor in the high-pressure pump could occur at specific operating points which is now effectively prevented with the present invention.

According to another advantageous embodiment of the present invention, it is suggested that the low-pressure pump is configured as an electrical fuel pump. When, in accordance with the present invention, the prepressure with which the fuel is applied to the high-pressure pump can be reduced at specific operating points of the engine, a low-pressure pump configured as an electrical fuel pump has the advantage that it exhibits a reduced takeup of power, that is, consumes less current.

A preferred embodiment of the present invention is explained in greater detail in the following with reference to the drawings, wherein:

DESCRIPTION OF THE PREFERRED EMBODIMENTS OF THE INVENTION

Figure 1:
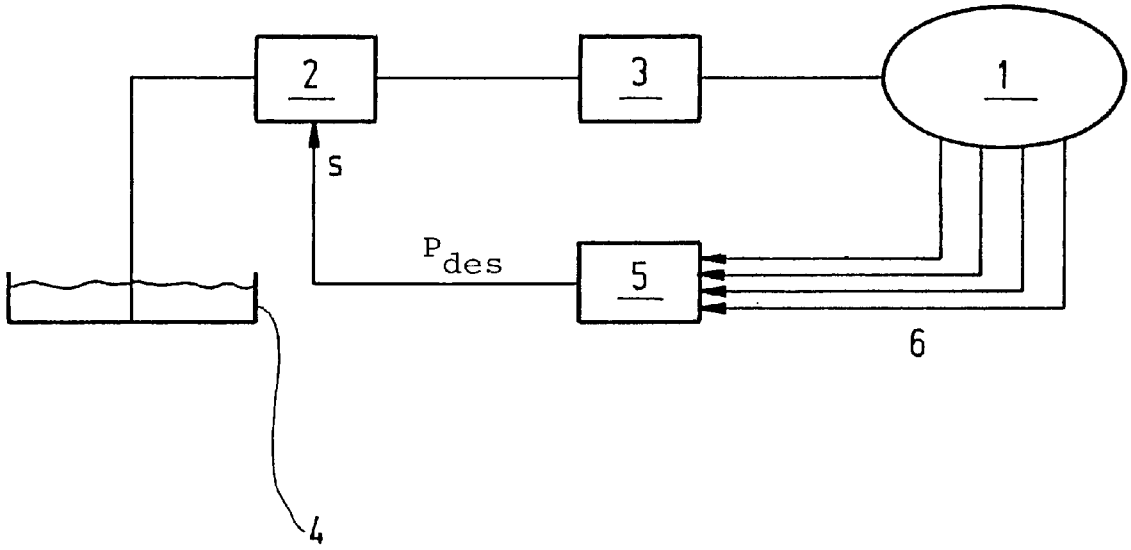
FIG. 1 is a schematic representation of an internal combustion engine which is supplied with fuel from a combination of a low-pressure pump and a high-pressure pump; and, FIG. 2 is a schematic representation of the method according to the invention pursuant to a preferred embodiment.

In FIG. 1, a direct-injecting internal combustion engine is symbolically illustrated and is identified by reference numeral 1. The engine 1 is supplied with fuel from a fuel tank 4 via a combination of a low-pressure pump 2 and a high-pressure pump 3. The low-pressure pump 2 is configured as an electrical fuel pump. The low-pressure pump 2 pumps the fuel from the fuel tank 4 to the high-pressure pump 3 and is controlled by requirements. The fuel, which is pumped by the low-pressure pump 2, lies at a prepressure p_des on the high-pressure pump 3. The high-pressure pump 3 is configured as a piston pump.

Figure 2:
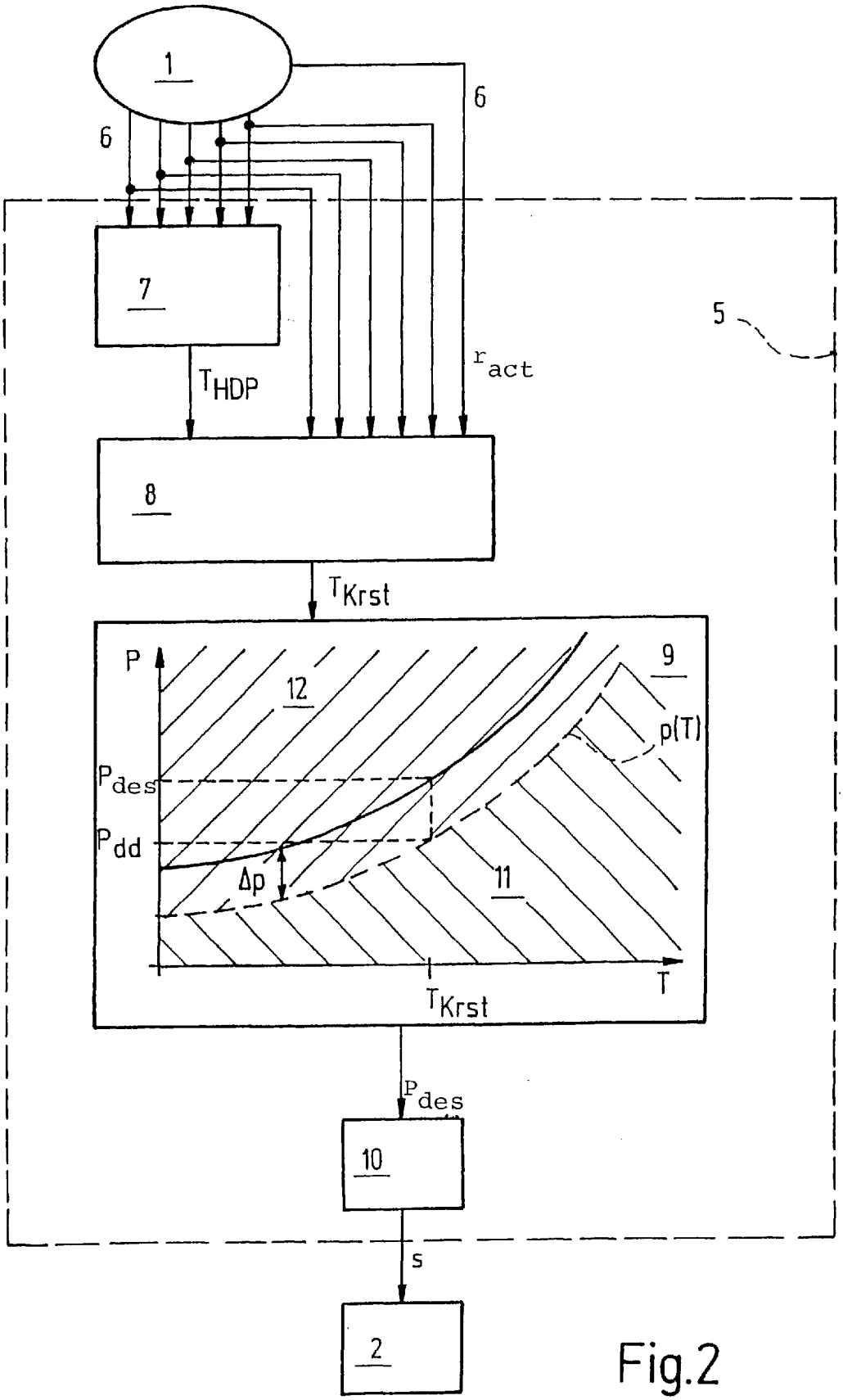

During operation of the engine 1, the engine is supplied with fuel by the low-pressure pump 2 and the high-pressure pump 3. Very high operating temperatures can develop especially in the high-pressure pump 3 and these high temperatures can lead to a vaporization of fuel in the high-pressure pump 3. To avoid this, the prepressure p_des, with which the fuel is applied to the high-pressure pump 3, is controlled (open loop and/or closed loop) to a value which, on the one hand, is as small as possible in order to not unnecessarily load the low-pressure pump 2, and wherein, on the other hand, a vaporization of the fuel in the high-pressure pump 3 is reliably avoided. The control (open loop and/or closed loop) of the prepressure p_des takes place in accordance with the method of the invention which hereinafter is explained in detail in FIG. 2.

For carrying out the method of the invention, a control apparatus 5 is provided which is configured as an independent control unit or as part of a higher order control apparatus for controlling the engine 1. During operation of the engine 1, condition variables 6 of the internal combustion engine 1 are detected. As condition variables 6, the following can be applied: for example, the temperature of the internal combustion engine 1, of the intake air and/or of the ambient, the integral of the fuel throughput and/or of the air throughput, the pumping capacity, the lost power and/or the efficiency of the high-pressure pump 3, the rpm of the high-pressure pump 3 and/or of the engine 1, the air/fuel ratio lambda and/or the control of a quantity control valve and/or a pressure control valve.

The condition variables 6 are supplied to the control apparatus 5 where they are utilized for estimating the temperature T_HDP of the high-pressure pump 3 and for estimating the fuel temperature T_Krst based on physical models of the high-pressure pump 3. The physical model of the high-pressure pump 3 for estimating the temperature T_HDP of the high-pressure pump 3 is contained in a function block 7 of the control apparatus 5. The physical model of the high-pressure pump 3 for estimating the fuel temperature T_Krst is contained in a function block 8 of the control apparatus 5. The fuel temperature T_Krst can be computed based on the same condition variables 6 which are also applied for estimating the temperature T_HDP of the high-pressure pump 3, and/or based on other condition variables 6. Especially, the actual throughput r_act of fuel in the engine 1 is determined and the fuel temperature T_Krst in the high-pressure pump 3 is determined while considering the fuel throughput r_act .

A fuel vapor pressure characteristic line p(T) is stored in a function block 9 of the control apparatus 5. The fuel vapor pressure characteristic line p(T) provides at which prepressure p the fuel in the high-pressure pump 3 passes from the vaporous state into the liquid state at a specific operating temperature T of the fuel. The fuel in the high-pressure pump 3 vaporizes in the region 11 below the fuel vapor pressure characteristic line p(T). In contrast, the fuel in the high-pressure pump 3 is liquid in the region 12 above the fuel vapor pressure characteristic line p(T).

The modeled fuel temperature T_Krst is supplied to the function block 9. A value of the prepressure p_dd is taken from the fuel vapor pressure characteristic line p(T) to which a safety reserve pressure delta_p is added. The value of the prepressure p_dd corresponds to the fuel temperature T_Krst. The sum of the prepressure p_dd , which is taken from the fuel vapor pressure characteristic line p(T), and the safety reserve pressure delta_p yields the prepressure p_des which is to be adjusted and at which the fuel should be applied to the high-pressure pump 3 so that a vaporization of fuel in the high-pressure pump 3 is reliably avoided. The prepressure p_des, which is to be adjusted, is generated by correspondingly driving or controlling the low-pressure pump 2. For this purpose, a control variable s is determined in a function block 10 of the control apparatus 5 and is then supplied to the low-pressure pump 2. The control variable s corresponds to the prepressure p_des which is to be adjusted.

The input variables of the control apparatus 5 are the condition variables 6 of the engine 1. As an output variable, the control variable s is applied to the output of the control apparatus 5.

The method of the invention for varying the prepressure p_des of the high-pressure pump 3 affords especially the advantage that the prepressure p_des can be reduced for a high fuel throughput r_act of the engine 1, which leads to relieving load on the low-pressure pump 2. Furthermore, the low-pressure pump 2 takes up less power for a reduced prepressure p_des.

Alternatively to the described embodiment, the prepressure p_des can also be estimated based on a physical model of the high-pressure pump 3 in dependence upon specific condition variables 6 of the engine 1.

What is claimed is:

1. A method for varying a prepressure (p_des) generated by a low-pressure pump and applied to a high-pressure pump with the low-pressure pump and the high-pressure pump pumping fuel for the internal combustion engine, the method comprising the steps of:

estimating the actual temperature (T_Krst) of the fuel in the high-pressure pump based on a physical model of the high-pressure pump in dependence upon the temperature (T_HDP) of the high-pressure pump and specific condition variables of the internal combustion engine;

determining a prepressure (p_des) as low as possible in dependence upon the fuel temperature (T_Krst) for which a vaporization of the fuel in the high-pressure pump is reliably avoided; and, controlling the low-pressure pump so that said low-pressure pump generates the determined prepressure (p_des).

2. The method of claim 1, comprising the further step of: determining the actual throughput (r_act) of fuel into the internal combustion engine and determining the fuel temperature (T_Krst) in the high-pressure pump while considering the fuel throughput (r_act).

3. The method of claim 1, comprising the further step of estimating the temperature (T_HDP) of the high-pressure pump based on a physical model of the high-pressure pump in dependence upon specific condition variables of the internal combustion engine.

4. The method of claim 3, wherein the condition variables of the internal combustion engine are weighted in dependence upon the type of internal combustion engine and on the operating point.

5. The method of claim 3, wherein the fuel vapor pressure characteristic line (p(T)) for a worst-case scenario is determined and stored.

6. The method of claim 5, wherein the type of tanked fuel is detected and the stored fuel vapor pressure characteristic line (p(T)) is adapted to the type of tanked fuel.

7. The method of claim 1, comprising the further step of determining the prepressure (p_des) based on a fuel vapor pressure characteristic line (p(T)) from which a value of the prepressure (p_dd) is taken to which a safety reserve pressure (delta_p) is added (p_des=p_dd+delta_p), with the value of the prepressure (p_dd) corresponding to the fuel temperature (T_Krst).

8. The method of claim 1, comprising the further step of estimating the prepressure (p_des) based on a physical model of the high-pressure pump in dependence upon specific condition variables of the internal combustion engine.

9. The method of claim 8, wherein the following are applied as condition variables: the temperature of the internal combustion engine, of the intake air and/or of the ambient, the integral of the fuel throughput (r_act) and/or of the air throughput, the pumping power, the lost power and/or the efficiency of the high-pressure pump, the rpm of the high-pressure pump and/or the rpm of the internal combustion engine, the air/fuel ratio (lambda) and/or the control of a quantity control valve and/or of a pressure control valve.

10. A control arrangement for varying a prepressure (p_des) generated by a low-pressure pump and applied to a high-pressure pump with the low-pressure pump and the high-pressure pump pumping fuel for an internal combustion engine, the control arrangement comprising:

means for estimating the actual temperature (T_Krst) of the fuel in the high-pressure pump based on a physical model of the high-pressure pump in dependence upon the temperature (T_HDP) of the high-pressure pump and specific condition variables of the internal combustion engine;

means for determining a prepressure (p_des) as low as possible in dependence upon the fuel temperature (T_Krst) for which a vaporization of the fuel in the high-pressure pump (3) is reliably avoided; and, means for controlling the low-pressure pump so that said low-pressure pump generates the determined prepressure (p_des).

* * * * *